United States Patent [19]

Schaffer

[11] Patent Number: 4,592,450

[45] Date of Patent: Jun. 3, 1986

[54] ELEVATOR

[76] Inventor: Wolfgang Schaffer, Laxenburger Strasse 117, A-1100 Vienna, Austria

[21] Appl. No.: 597,444

[22] PCT Filed: Aug. 6, 1982

[86] PCT No.: PCT/AT82/00023

§ 371 Date: Apr. 6, 1984

§ 102(e) Date: Apr. 6, 1984

[87] PCT Pub. No.: WO84/00743

PCT Pub. Date: Mar. 1, 1984

[51] Int. Cl.[4] ..... B66B 11/04; B66B 11/08; B66B 7/04

[52] U.S. Cl. ..... 187/19; 187/20; 187/95

[58] Field of Search ..... 187/19, 20, 25, 95, 187/8.69, 21, 94; 105/29 R; 238/123; 74/422; 254/95, 97

[56] References Cited

U.S. PATENT DOCUMENTS

| | | | |
|---|---|---|---|
| 283,431 | 8/1883 | Smith | 187/19 |
| 319,099 | 6/1885 | Koneman | 187/21 |
| 571,864 | 11/1896 | Parkhurst | 187/19 |
| 1,977,484 | 10/1933 | Lagerquist et al. | 187/24 |
| 3,215,227 | 11/1965 | MacChesney | 187/24 |
| 4,051,923 | 10/1977 | Blanchette et al. | 187/25 |

FOREIGN PATENT DOCUMENTS

| | | |
|---|---|---|
| 21438 | 11/1969 | Australia . |
| 51756 | 7/1889 | Fed. Rep. of Germany . |
| 2159081 | 6/1973 | Fed. Rep. of Germany . |
| 727637 | 6/1932 | France . |
| 1483626 | 6/1967 | France . |
| 6511972 | 3/1967 | Netherlands . |

*Primary Examiner*—Joseph J. Rolla
*Assistant Examiner*—Nils E. Pedersen

[57] ABSTRACT

An elevator has a pair of vertical and parallel T-section rails having central legs directed toward each other, forming a vertical plane, and formed with straight-across teeth. A car vertically displaceable between the rails has respective pairs of guides flanking the rails and restricting movement of the car horizontally only perpendicular to the plane. Respective sprockets rotatable on the car about axes perpendicular to the plane also have straight-across teeth meshing with the rail teeth. These sprockets lie in the plane and constitute the only restriction of horizontal movement of the car relative to the rails in the plane A drive synchronously rotates the sprockets to vertically displace the car along the plane on the rails. A manual safety can vertically displace the car along the rails. The guides are disks fixed to and sandwiching the sprockets. A brake on the car operatively engageable with the sprockets can arrest the car if the power fails or the like. An idler wheel between the rails above the car carries a cable having two ends, one of which is attached to the car. A counterweight is attached to the other cable end, the manual safety being coupled to the idler wheel.

7 Claims, 5 Drawing Figures

ELEVATOR

FIELD OF THE INVENTION

The present invention relates to an elevator. More particularly this invention concerns a so-called zero-headroom elevator suitable for installation in existing structures.

BACKGROUND OF THE INVENTION

A standard elevator has a shaft vertically traversing a plurality of different floors of a building and a cabin or car guided on vertical rails in the shaft. A cable has one end connected to the top of the car and another end connected to a counterweight, and is looped over a pulley mounted at the top of the shaft. A motor typically mounted in a room that is provided on the building roof is connected to this pulley, so it can rotate it in one direction to raise the elevator and sink the counterweight, and in the opposite direction to lower the elevator and raise the counterweight. This counterweight weighs about as much as the car plus its average load, although for various reasons it can weigh more or less.

Such a structure requires that a substantial room be devoted to the cumbersome drive. Since the motor must be able to move the entire high-inertia mass of the elevator, the counterweight, and any passengers or freight, it must be fairly powerful, so it is fairly large. When provided on the building roof this motor room uses normally otherwise unused space. However, in an existing structure it is frequently not possible to mount it on the roof, as the building is not designed for such a load. Providing the drive at the base of the shaft can solve this problem, although developing such underground space is normally very difficult and expensive.

Hence recourse has been had to zero-headroom elevators which carry their own drives, so that the elevator shaft need not extend much above or below the floors being served. Such an elevator can be installed in an existing structure fairly easily.

The typical such system guides the car on four rails formed with straight-across teeth, that is teeth whose flanks are formed by families of lines that are all parallel and perpendicular to the longitudinal direction of the rails. These rails are engaged by respective complementarily toothed sprockets carried by respective drive motors. Even when assembled to high tolerances, such an arrangement wears rapidly, as the four sprockets inherently work somewhat differentially on the rails. Simple thermal expansion of the system can cause it to bind and wear excessively, and other factors can desynchronize the sprockets just as easily. Once such an arrangement has worn a little, the rate of wear increases rapidly.

Another arrangement has only two toothed rails that are engaged by respective sprockets driven by respective worms sitting on the opposite ends of a motor shaft. To facilitate meshing, the sprockets have teeth each of whose one flank is inclined corresponding to the pitch of the worm and whose other flank is straight, that is parallel to the radius. Such teeth are unfortunately weaker one one side of the sprocket than on the other. The teeth of the rail are complementarily formed as a row of recesses, that is they are not laterally open, and the teeth of one face of the rail are narrower than the other rail face. Such teeth cannot be produced easily, and are very difficult to machine to close tolerances. Hence such a system also wears rapidly.

It is also known for the two rails to have confronting faces formed as racks with straight-across teeth engaged by respective complementary sprockets driven by the same motor. Each rail has a pair of oppositely directed guide grooves lying in a vertical plane perpendicular to the plane of the rails. Four respective angle irons carried on the car have flanges projecting vertically into these grooves, thereby accurately guiding the car on the rails. Such an arrangement can bind readily and will wear rapidly when not in perfect alignment.

In fact such zero-clearance elevators have all proven so troublesome that they are no longer made or used on any meaningful scale.

OBJECTS OF THE INVENTION

It is therefore an object of the present invention to provide an improved zero-clearance or self-driving elevator.

Another object is the provision of such a zero-clearance or self-driving elevator which overcomes the above-given disadvantages, that is which does not present the considerable alignment and wear problems of the prior-art arrangements.

SUMMARY OF THE INVENTION

An elevator according to this invention has a pair of vertical and parallel T-section rails having central legs directed toward each other, forming a vertical plane, and formed with straight-across teeth. A car vertically displaceable between the rails has respective pairs of guides flanking the rails and restricting movement of the car horizontally only perpendicular to the plane. Respective sprockets rotatable on the car about axes perpendicular to the plane also have straight-across teeth meshing with the rail teeth. These sprockets lie in the plane and constitute the only restriction of horizontal movement of the car relative to the rails in the plane, A drive synchronously rotates the sprockets to vertically displace the car along the plane on the rails. A manual safety can vertically displace the car along the rails. The guides of this invention are disks fixed to and sandwiching the sprockets, the disks of each pair symmetrically flanking the elevator plane.

In addition according to this invention a brake on the car operatively engageable with the sprockets can arrest the car if the power fails or the like. An idler wheel between the rails above the car carries a cable having two ends, one of which is attached to the car. A counterweight is attached to the other cable end, the manual operator being coupled to the idler wheel.

With this arrangement the engagement of the teeth is all that limits movement of the car parallel to the plane. Thus any wear on one side will simply result in a slight lateral shifting of the car, without binding or stressing the other side. The car will be self-centering, and even if the gear teeth wear somewhat, the overall rate of wear will not increase. In fact if the sprockets wear considerably all that will happen is that the car will sit somewhat lower between the rails. Another advantage of this arrangement is that forces are automatically distributed evenly between the two sides of the car, so that wear will be even.

According to this invention the manual operating means includes a hand-operable actuating element such as a crank or handwheel, a transmission connectable between the element and the idler wheel, and control means connected between the element and the brake for releasing same when the element is connected via the transmission to the wheel. The transmission can include a pair of bevel gears engageable like a jaw-type clutch with each other to couple the element to the wheel and a coupling chain. Thus this drive can be provided in the side of the shaft, normally at the uppermost story of the building incorporating the elevator.

DESCRIPTION OF THE DRAWING

The above and other features and advantages will become more readily apparent from the following, reference being made to the accompanying drawing in which.

SPECIFIC DESCRIPTION

Figure 1:
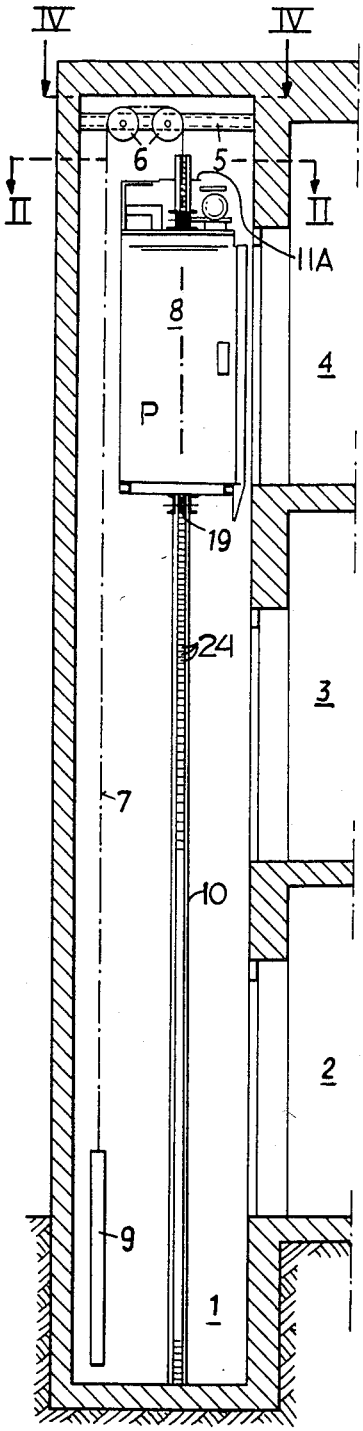
FIG. 1 is a small-scale vertical section through an elevator according to this invention with the car all the way to the top.

As seen in FIG. 1 an elevator shaft 1 vertically traverses three stories or floors 2, 3, and 4 that open into this shaft 1. A frame 5 at the top of the shaft 1 supports a pair of idler pulleys 6 over which is reeved a cable 7 having one end attached to a car 8 and an opposite end connected to a counterweight 9. This car 8 can move up and down on the shaft 1 between two parallel and vertical rails 10 lying in a plane P. The car 8 can communicate forwardly away from the plane with whichever of the floors 2, 3, or 4 it is aligned with. The counterweight 9 is guided behind this plane P in vertical guide rails 9*a* and has a weight equal to that of the empty car plus about 40% of the average load.

Figure 2:
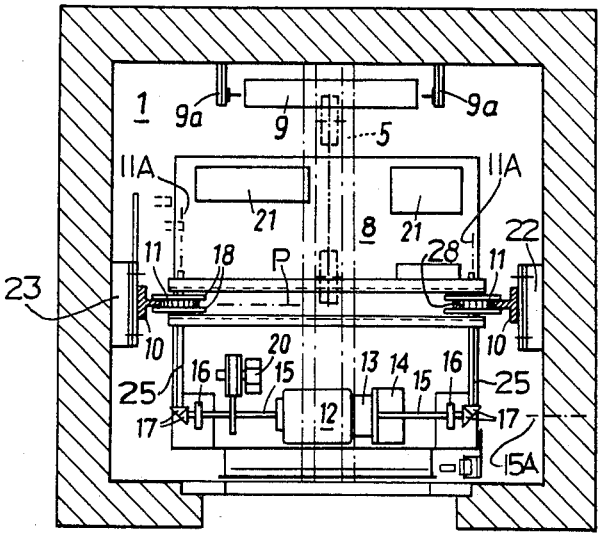
FIG. 2 is a large-scale horizontal section taken along line II—II in FIG. 1.

These rails 10 are identical and are as shown in FIG. 2 of T-section, each having a pair of arms fixed to the anchors 22 in the sides of the shaft 1 and a central leg formed as a rack with straight-across teeth 24 (FIG. 1). The car 8 carries on its roof a pair of sprocket wheels 11 lying in the plane P and rotatable about axes 11A perpendicular thereto. These sprockets 11 have teeth 28 complementary to and meshing with the teeth 24 and are each sandwiched between two large-diameter circular disks 18 of a diameter substantially greater than the sprocket diameter so that they flank the leg of the respective rail 10 and substantially prevent the car 8 from moving horizontally perpendicular to the plane P.

Each sprocket 11 is in turn carried on a shaft 25 extending along the respective axis 11A and connected via a pair of bevel gears 17 to another shaft 15 centered on an axis 15A parallel to the plane P and perpendicular to the axes 11A. This shaft 15 is journaled in pillow blocks 16 on the roof of the car 8 and is connected via a transmission 13 to an electric drive motor 12 also carried on the car roof. This shaft also is connected to a brake 14 and to a governor or speed monitor 20 both connected to a controller 21.

Underneath the car are two idler sprockets or wheels 19 similar to the sprockets 11. They may be provided with the brake 14 and/or speed regulator 20 according to this invention. They serve only to prevent canting of the car 8 about a horizontal axis perpendicular to the plane P.

With this arrangement the load will be carried by the teeth of the rails 10 and sprockets 11. Since the two sprockets 11 are driven synchronously, any irregularities will be reflected in a shift in the plane P, automatically equalizing the load on the two sprockets 11. Even if the car 8 is loaded offcenter it will automatically shift slightly in the plane P to equalize force on the two rails 10. If the teeth 24 and 28 wear considerably, the only result will be that the car 8 will ride a little lower than when they were new, but the arrangement will still operate smoothly and quietly. As a result wear is minimized, and wear will not increase disproportionately when the teeth become worn.

Figure 3:
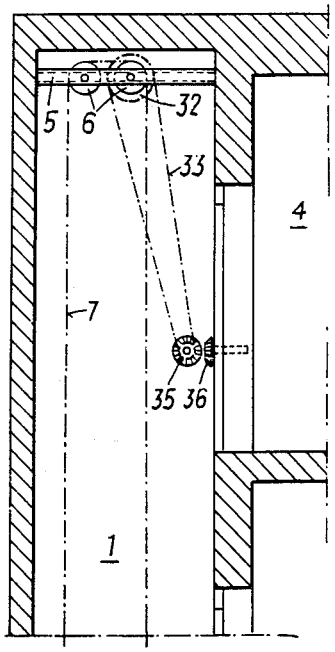
FIG. 3 is a view corresponding to a detail of FIG. 1, but with the car down.
Figure 4:
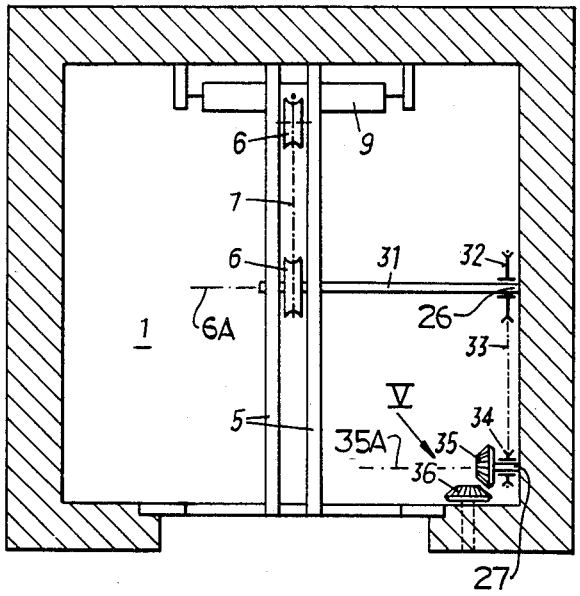
FIG. 4 is a large-scale horizontal section taken along line IV—IV of FIG. 1.

According to a further feature of this invention, as seen in FIGS. 3 and 4, the one idler sprocket 6 is actually carried on one end of a shaft 31 journaled at 26 in the side wall of the shaft 1 in axial alignment with the sprocket 6 and carrying at its outer end a sprocket 32 connected via a chain 33 to another sprocket 34 journaled at 27 in the same shaft wall. The shaft 31, sprocket 6, and sprocket 32 are all rotatable about a horizontal axis 6A lying in or parallel to the plane P.

Figure 5:
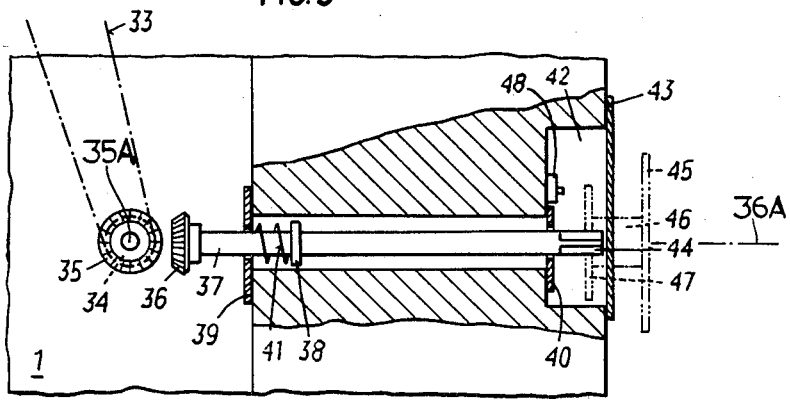
FIG. 5 is a large-scale and partly sectional view of the detail indicated at V in FIG. 4.

As better seen in FIG. 5 this sprocket 34 is fixed to a bevel gear 35 rotatable about an axis 35A parallel to the axis 6A but at the extreme front end of the shaft 1. Another bevel gear 36 carried on a shaft 37 is rotatable about a horizontal axis 36A perpendicular to the axis 35A and to the plane P. These gears 35 and 36 can be provided at the top of the shaft or, by suitable extension of the chain 33, anywhere therein, as the coupling chain 33 lies wholly to the side of the moving parts.

The shaft 37 is also axially slidable in an inside plate 39 mounted in the front wall of the shaft 1 and in an outside plate 40 received in a pocket 42 formed beneath an access cover 43 provided on the front or public side of this wall. A coil-type spring 41 is engaged around the shaft 37 and is braced between the front face of the plate 39 and a ring 38 fixed on the shaft 37, so as to urge this shaft 37 and the gear 36 forwardly to bring the gears 35 and 36 out of engagement with each other.

An actuating element such as a handwheel 45 has a collar 46 engageable over a polygonal-section end 44 of the shaft 37 to rotationally couple the handwheel 45 and shaft 37. Engagement of the collar 46 over the end 44 and pushing it backward along the axis 36A will compress the spring 41 and engage the gears 35 and 36 together. In addition a front flange 47 on the handwheel 45 can engage and actuate a switch 48 mounted in the back of the recess 42. This switch 48 is connected via the controller 21 to the brake 14 to release it.

Normally the car 8 is provided with a trickle-charged battery that can operate the brake 14 if power fails. In the event of such an emergency it is nonetheless necessary to move a car 8 stranded between floors. The cover 43 is removed and a handwheel 45 is fitted over the shaft end 44. The wheel 45 is then pressed in to engage the gears 35 and 36 and disengage the brake 24 and is then turned in the appropriate direction to raise or lower the car 8.

Of course the elevator according to this invention can be provided with the standard self-locking brakes that grab the rails 10 in the event of cable failure, and the governor 20 can similarly be set up to operate the brake 14 if the car speed exceeds 1.4 times its rated speed. A wiring harness connecting the drive motor and controller to the external source of power, door switches, and the like is also provided but is not shown here for clarity of view.

In addition a manual drive of the type shown in FIGS. 3 through 5 can be provided in the car 3, effective on the shafts 12 or 25. The chain connection can be replaced by a universal joint, and other obvious kinematic changes are of course also within the scope of this invention.

What is claimed is:

1. An elevator for use in a multistory building, the elevator comprising:

a pair of vertical and parallel rails forming a vertical plane and formed with straight-across teeth;

a car vertically displaceable between the rails;

an idler wheel between the rails above the car;

a cable looped over the idler wheel and having two ends, one of which is attached to the car;

a counterweight attached to the other cable end;

respective sprockets rotatable on the car about axes perpendicular to the plane and having straight-across teeth meshing with the rail teeth, the sprockets lying in the plane;

drive means for synchronously rotating the sprockets to vertically displace the car along the plane on the rails;

a hand-operable actuating element in the building outside the car; and means including a transmission connectable between the element and the idler wheel for manually vertically displacing the car along the rails.

2. The elevator defined in claim 1, further comprising means including guide disks fixed to and sandwiching the sprockets, flanking the rails, and restricting movement of the car horizontally only perpendicular to the plane.

3. The elevator defined in claim 1, further comprising:

a brake on the car operatively engageable with the sprockets.

4. The elevator defined in claim 3 wherein the manual means includes control means connected between the element and the brake for releasing same when the element is connected via the transmission to the wheel.

5. The elevator defined in claim 4 wherein the transmission includes a pair of bevel gears engageable with each other to couple the element to the wheel.

6. The elevator defined in claim 4 wherein the transmission includes a coupling chain.

7. The elevator defined in claim 4 wherein the manual means is operable from the uppermost story of the building.

* * * * *